US011524497B2

(12) United States Patent
Shimotsusa et al.

(10) Patent No.: US 11,524,497 B2
(45) Date of Patent: Dec. 13, 2022

(54) LIQUID DISCHARGE HEAD AND LIQUID DISCHARGE DEVICE

(71) Applicant: CANON KABUSHIKI KAISHA, Tokyo (JP)

(72) Inventors: Mineo Shimotsusa, Tokyo (JP); Hiroyasu Nomura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/242,747

(22) Filed: Apr. 28, 2021

(65) Prior Publication Data

US 2021/0370669 A1 Dec. 2, 2021

(30) Foreign Application Priority Data

May 29, 2020 (JP) ..... JP2020-094907

(51) Int. Cl.
*B41J 2/045* (2006.01)
*B41J 2/14* (2006.01)

(52) U.S. Cl.
CPC ..... *B41J 2/04563* (2013.01); *B41J 2/0458* (2013.01); *B41J 2/14032* (2013.01)

(58) Field of Classification Search
CPC ..... B41J 2/14153
See application file for complete search history.

(56) References Cited

U.S. PATENT DOCUMENTS

| | | | | |
|---|---|---|---|---|
| 10,493,774 | B2 | 12/2019 | Kanno et al. | |
| 10,882,314 | B2 | 1/2021 | Shimotsusa et al. | |
| 2007/0291069 | A1* | 12/2007 | Shihoh | B41J 2/2142 347/19 |
| 2009/0002428 | A1* | 1/2009 | Min | B41J 2/0458 347/19 |
| 2009/0085946 | A1* | 4/2009 | Aoki | B41J 2/04573 347/17 |
| 2021/0060927 | A1* | 3/2021 | Oikawa | B41J 2/165 |
| 2021/0086508 | A1* | 3/2021 | Ishiwata | B41J 2/04555 |

FOREIGN PATENT DOCUMENTS

| | | | |
|---|---|---|---|
| JP | 2009-196265 | A | 9/2009 |
| JP | 2019-072999 | A | 5/2019 |

* cited by examiner

*Primary Examiner* — Julian D Huffman
(74) *Attorney, Agent, or Firm* — Venable LLP

(57) ABSTRACT

A liquid discharge head, comprising an insulating member arranged on a substrate, a resistive heating element arranged in the insulating member and configured to generate thermal energy used to discharge a liquid, a bubble chamber provided above the insulating member and configured to generate bubbles of the liquid based on the thermal energy, and a temperature detection element capable of detecting a temperature in the bubble chamber, wherein the temperature detection element is arranged between the resistive heating element and the bubble chamber and in a conductive layer closest to the bubble chamber in a plurality of conductive layers provided with respect to the insulating member.

15 Claims, 12 Drawing Sheets

LIQUID DISCHARGE HEAD AND LIQUID DISCHARGE DEVICE

BACKGROUND OF THE INVENTION

Field of the Invention

The present invention mainly relates to a liquid discharge head.

Description of the Related Art

A liquid discharge head of a liquid discharge device represented by an inkjet printer or the like can employ a configuration of, for example, an electrothermal conversion type or a piezoelectric type. A liquid discharge head of an electrothermal conversion type includes a plurality of liquid discharge nozzles and a plurality of resistive heating elements (also called electrothermal transducers or the like) corresponding to these, and discharges a liquid from corresponding nozzles using thermal energy generated by driving individual resistive heating elements. Such a configuration of an electrothermal conversion type can simultaneously implement size reduction of a resistive heating element and improvement of heat generation efficiency and is therefore advantageous in increasing the density of resistive heating elements.

In some liquid discharge devices, a temperature detection element (temperature sensor) is provided on a liquid discharge head, and drive control of resistive heating elements is performed based on the detection result of the temperature detection element (Japanese Patent Laid-Open Nos. 2019-72999 and 2009-196265).

It can be said that when the detection accuracy of the temperature detection element is improved, drive control of the resistive heating elements can be performed at a higher accuracy based on the detection result of the temperature detection element. In this respect, there is room for structural improvement in the configurations of Japanese Patent Laid-Open Nos. 2019-72999 and 2009-196265.

SUMMARY OF THE INVENTION

It is an exemplary object of the present invention to provide a technique advantageous in improving the detection accuracy of a temperature detection element.

One of the aspects of the present invention provides a liquid discharge head comprising an insulating member arranged on a substrate, a resistive heating element arranged in the insulating member and configured to generate thermal energy used to discharge a liquid, a bubble chamber provided above the insulating member and configured to generate bubbles of the liquid based on the thermal energy, and a temperature detection element capable of detecting a temperature in the bubble chamber, wherein the temperature detection element is arranged between the resistive heating element and the bubble chamber and in a conductive layer closest to the bubble chamber in a plurality of conductive layers provided with respect to the insulating member.

Further features of the present invention will become apparent from the following description of exemplary embodiments (with reference to the attached drawings).

DESCRIPTION OF THE EMBODIMENTS

Figure 1A:
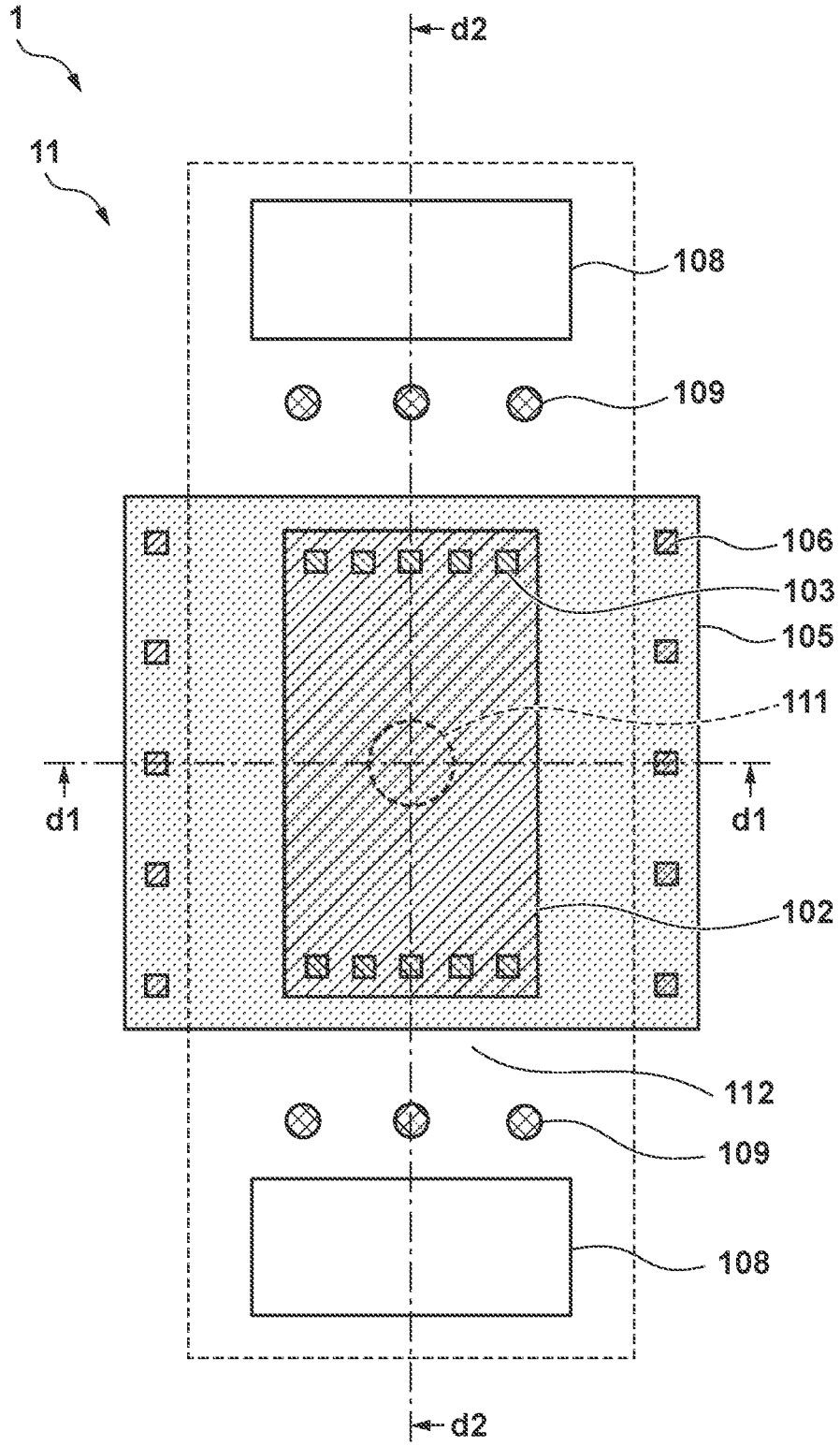
FIG. 1A is a schematic plan view of a liquid discharge head.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are given to the same or similar configurations, and redundant description thereof is omitted.

First Embodiment

Figure 1B:
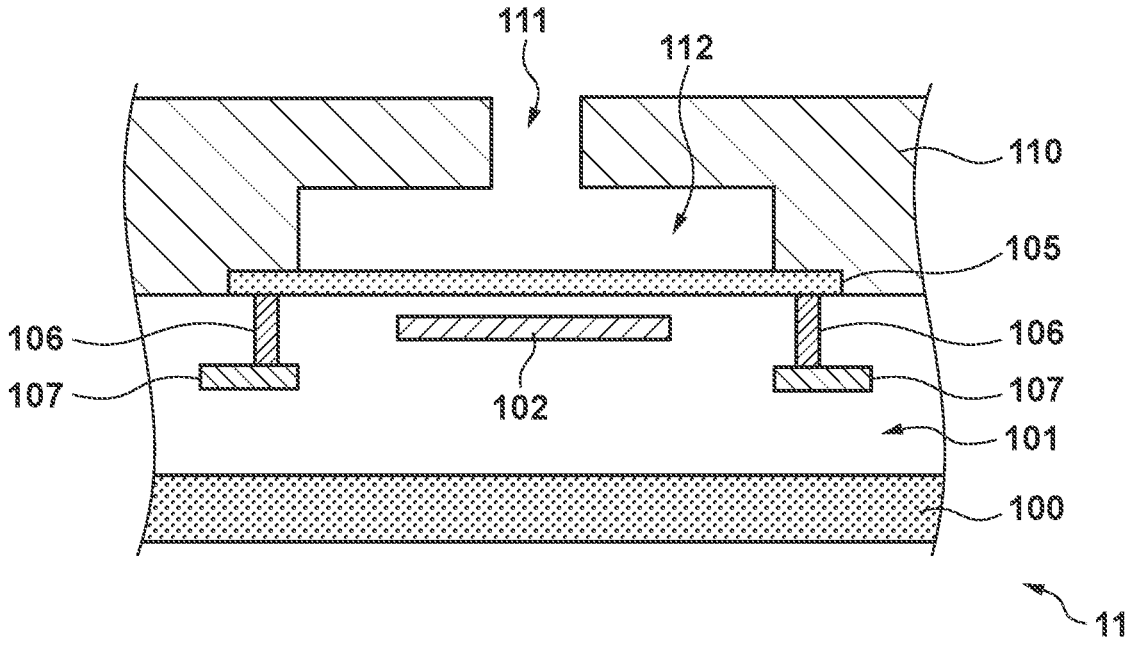
FIG. 1B is a schematic sectional view of the liquid discharge head.
Figure 1C:
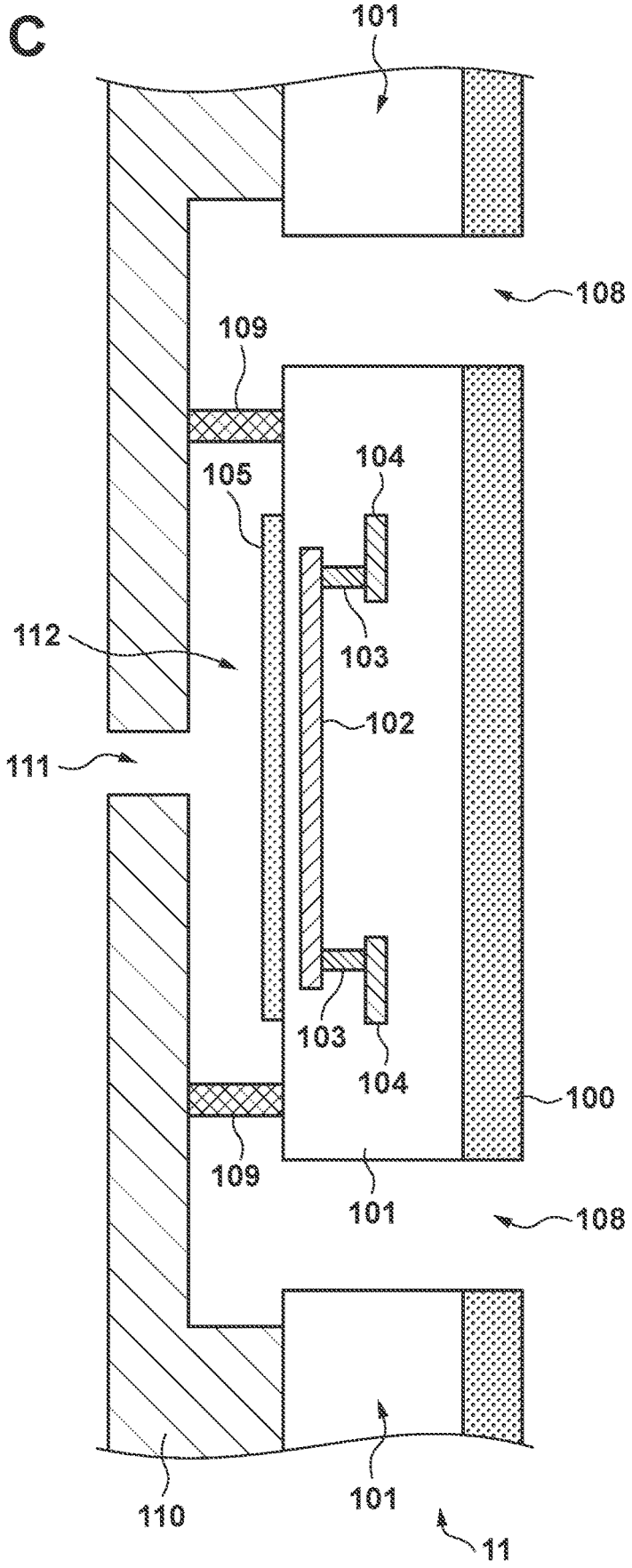
FIG. 1C is a schematic sectional view of the liquid discharge head.

FIG. 1A is a schematic plan view of a head substrate 11 included in a liquid discharge head 1 according to the first embodiment. FIG. 1B is a schematic sectional view taken along a cut line d1-d1 in FIG. 1A. FIG. 1C is a schematic sectional view taken along a cut line d2-d2 in FIG. 1A. The liquid discharge head 1 is provided in a liquid discharge device represented by an inkjet printer or the like, and can apply a liquid such as an ink droplet to a predetermined target.

Note that to easily make an explanation, the upper side of FIGS. 1B and 1C (a side in the direction of discharging a liquid) is defined as the upper side of the liquid discharge head 1 and the head substrate 11, and the opposite side is defined the lower side.

The head substrate 11 can be manufactured by a known semiconductor manufacturing process, and is formed by, for example, providing a plurality of elements on a substrate 100 made of a semiconductor such as a single crystal silicon. First, an insulating layer 101 is arranged on the substrate 100.

For the insulating layer 101, for example, an inorganic material such as silicon oxide is used. The insulating layer 101 electrically isolates a plurality of resistive heating elements 102 (to be described later) and one or more elements (for example, MOS transistors) or circuit portions configured to drive the individual resistive heating elements 102 from each other. In general, the insulating layer 101 is formed by a plurality of layers, and a plurality of conductive layers or semiconductor layers forming the individual elements can be arranged between, on, and/or under these. The insulating layer 101 may be called an insulating member.

In the insulating layer 101, the resistive heating elements 102, connecting members 103, and wiring members 104 are arranged. The resistive heating element 102 is an electrothermal transducer that is driven by energization and generates thermal energy. The connecting member 103 is also called a contact plug, a via, or the like. The wiring member 104 is also called a line pattern (or simply a pattern) or the like.

The resistive heating element 102 is connected to the wiring member 104 via the connecting member 103. The resistive heating element 102 can be made of, for example, a metal with a relatively large electric resistance, such as silicon tantalum nitride, tungsten nitride, or silicon.

The members 103 and 104 are made of a metal with a relatively low electric resistance. Typically, for example, tungsten, copper, or the like can be used for the connecting member 103, and, for example, aluminum, copper, or the like can be used for the wiring member 104.

A temperature detection element 105 is arranged on the insulating layer 101 to be located above the resistive heating element 102. In addition, connecting members 106 and wiring members 107 are arranged in the insulating layer 101. The temperature detection element 105 is used to perform drive control of the resistive heating element 102 based on the detection result, and can detect the temperature in a bubble chamber 112, as will be described later in detail. That is, the detection result of the temperature detection element 105 is acquired by a control unit (also called a drive control unit or a print control unit) (not shown), and the control unit performs drive control of the resistive heating element 102 based on the detection result.

The temperature detection element 105 overlaps the resistive heating element 102 and is provided up to the outer side of the outer edge of the resistive heating element 102 in a planar view. The connecting member 106 is also called a contact plug, a via, or the like. The wiring member 107 is also called a line pattern (or simply a pattern) or the like.

The temperature detection element 105 is connected to the wiring member 107 via the connecting member 106. The temperature detection element 105 can be made of, for example, a metal with a relatively large temperature coefficient for resistance, such as iridium, tantalum, titanium, tungsten, silicon, silicon tantalum nitride, or silicon tungsten nitride, or an alloy thereof. The temperature detection element 105 may be formed by a single layer, or may be formed by stacking a plurality of layers. Additionally, the temperature detection element 105 is preferably made of a material capable of functioning as an anti-cavitation film.

The members 106 and 107 are made of a metal with a relatively low electric resistance, like the members 103 and 104. Typically, for example, tungsten, copper, or the like can be used for the connecting member 106, and, for example, aluminum, copper, or the like can be used for the wiring member 107.

The upper surface of the insulating layer 101 is preferably planarized. Planarization processing can typically be performed by CMP (Chemical Mechanical Polishing). Note that the planarization processing is performed after formation of the connecting members 106 and before formation of the temperature detection element 105 but may be performed between individual processes for forming the above-described elements 102 to 107.

In this embodiment, the connecting members 103 and 106 are individually formed by manufacturing processes independent of each other. Hence, the connecting members 103 that connect the resistive heating element 102 and the wiring members 104 are integrally provided, and the connecting members 106 that connect the temperature detection element 105 and the wiring members 107 are integrally provided.

In this embodiment, the film thickness of the metal film that forms the resistive heating element 102 is about 10 to 50 nm. The film thickness of the metal film that forms the wiring members 104 is about 500 to 1,000 nm. In addition, the film thickness of the insulating layer 101 between the temperature detection element 105 and the resistive heating element 102 (that is, the distance from the upper surface of the metal film that forms the resistive heating element 102 to the lower surface of the metal film that forms the temperature detection element 105) is about 50 to 200 nm.

According to this embodiment, it is possible to relatively easily reduce the distance between the resistive heating element 102 and the temperature detection element 105, and the distance can be reduced as compared to a structure in which the temperature detection element is arranged under the resistive heating element. Also, according to this embodiment, the temperature detection element 105 is caused to also function as an anti-cavitation film, thereby making it possible to implement both improvement of the quality of the liquid discharge head 1 and reduction of the manufacturing cost.

Liquid supply ports 108 are provided on the lower surface side of the substrate 100. Also, filters 109 made of a photosensitive resin or the like and a nozzle forming member 110 are provided on the upper surface side of the substrate 100. The nozzle forming member 110 forms an orifice (nozzle) 111 and the bubble chamber 112.

As will be described later in detail, the bubble chamber 112 is a space or a region that contributes to discharge of a liquid by bubbling the liquid flowing from the supply port 108, and is formed up to the outer side of the outer edge of the resistive heating element 102 in a planar view. In the drawings, the bubble chamber 112 is partitioned by the nozzle forming member 110 and the filters 109.

With the above-described configuration, the liquid discharge head 1 discharges the liquid in the bubble chamber 112 from the orifice 111 using the thermal energy of the resistive heating element 102. If a part of the discharged liquid returns from the orifice 111 to the bubble chamber 112 (as a so-called tailing), the liquid is newly supplied from the supply port 108 to the bubble chamber 112, and the bubble chamber 112 is filled with the liquid. The temperature detected by the temperature detection element 105 complies with the ratio of the liquid returned from the orifice 111 to the bubble chamber 112 to the liquid newly supplied from the supply port 108. It is therefore possible to determine, based on the detection result of the temperature detection element 105, the liquid discharge form (whether the discharge has normally been performed).

As an example, the detection results of the temperature detection element 105 in a case in which the liquid is appropriately discharged from the orifice 111 and in a case in which it is not will be described below with reference to FIGS. 6A, 6B, and 7.

Figure 6A:
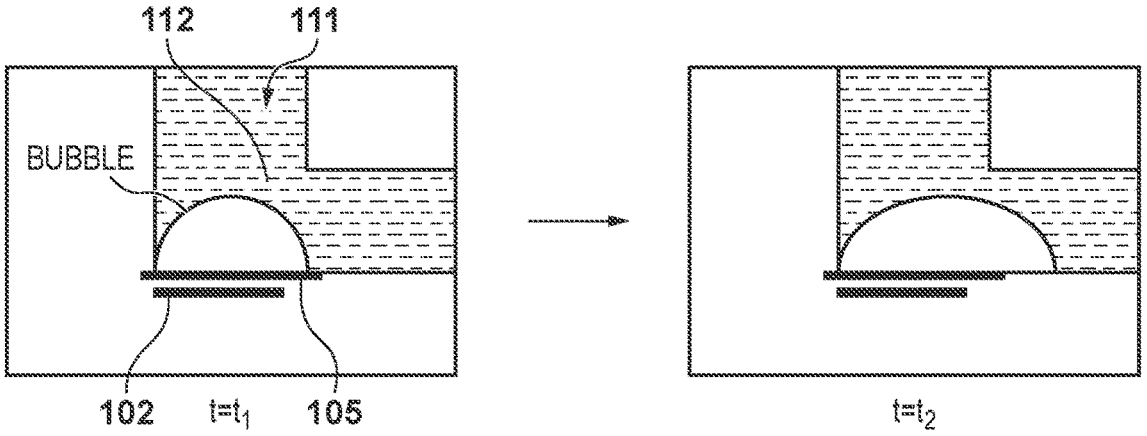
FIG. 6A is a schematic view showing the state of a liquid in a bubble chamber.
Figure 6B:
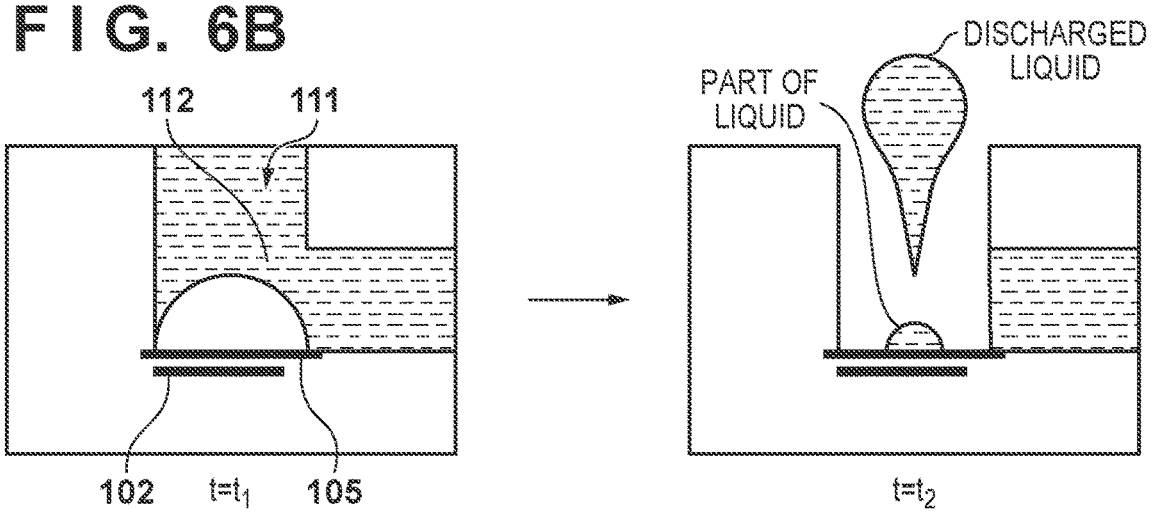
FIG. 6B is a schematic view showing the state of a liquid in a bubble chamber.

FIG. 6A is a schematic view showing a case in which the liquid is not appropriately discharged from the orifice 111, and FIG. 6B is a schematic view showing a case in which the liquid is appropriately discharged from the orifice 111.

The time elapsed from heating of the resistive heating element 102 is defined as time t. When t=t1, a bubble is generated on the temperature detection element 105 by heating of the resistive heating element 102 in both the cases shown in FIGS. 6A and 6B. The bubble contacts the upper surface of the temperature detection element 105 or covers the upper surface.

At t=t2 after that, in the case of FIG. 6A, the bubble remains on the temperature detection element 105. On the other hand, in the case of FIG. 6B, a part of the liquid returned from the orifice 111 to the bubble chamber 112 separates and contacts the upper surface of the temperature detection element 105.

Figure 7:
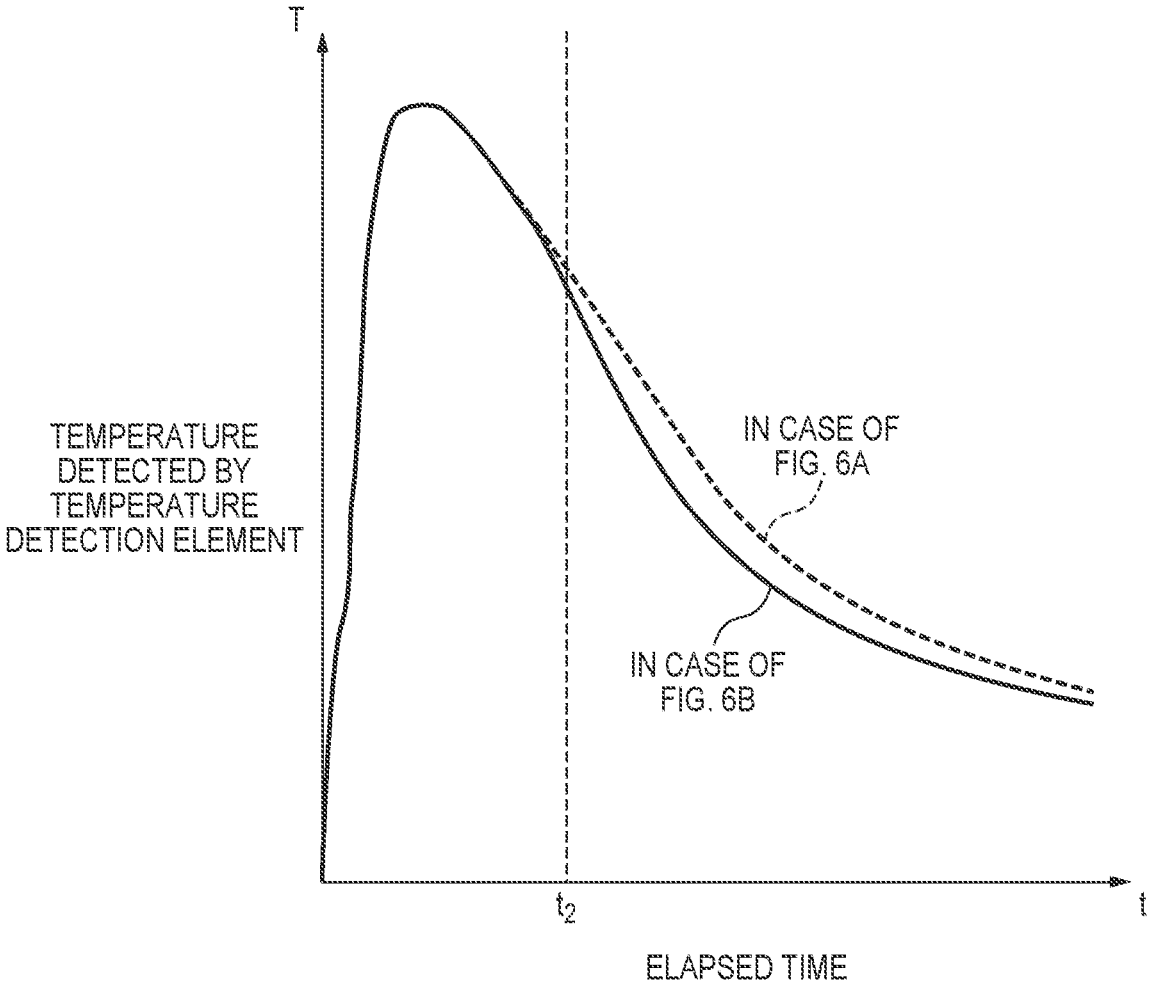
FIG. 7 is a view showing a temperature change detected by a temperature detection element.

FIG. 7 shows the detection results of the temperature detection element 105 in the above-described cases of FIGS. 6A and 6B, mainly, change forms of the temperature (to be referred to as a detection temperature hereinafter) detected by the temperature detection element 105. In FIG. 7, the abscissa represents the time t, and the ordinate represents the detection temperature.

As is apparent from FIG. 7, in the case of FIG. 6A, after t=t2, since a bubble contacts the upper surface of the temperature detection element 105, the detection temperature lowers in a relatively moderate change. On the other hand, in the case of FIG. 6B, after t=t2, since the heat of the upper portion of the temperature detection element 105 is absorbed by a part of the liquid, the detection temperature lowers relatively (as compared to the case of FIG. 6A) steeply.

According to this embodiment, as is apparent from FIGS. 1B and 1C, the temperature detection element 105 is arranged between the resistive heating element 102 and the bubble chamber 112 and located close to the liquid in the bubble chamber 112. The temperature detection element 105 is preferably arranged in the uppermost layer (the conductive layer closest to the bubble chamber 112) of the plurality of conductive layers formed in the insulating layer 101 using a semiconductor manufacturing process. Also, as can be seen from FIG. 1A, the temperature detection element 105 is located in the bubble chamber 112 in a planar view. According to this structure, the temperature detection element 105 can acquire a detection result at a high sensitivity.

Note that in this embodiment, changes may be made without departing from its scope. For example, the temperature detection element 105 need only be the uppermost layer immediately under the bubble chamber 112, and the insulating layer 101 may further include another upper layer at a position apart from the bubble chamber 112. In other words, the temperature detection element 105 need only be arranged in the conductive layer closest to the bubble chamber 112, and need only be located in the uppermost layer in a region overlapping the bubble chamber 112 in a planar view.

As described above, according to this embodiment, the detection accuracy of the temperature detection element 105 can be improved, and appropriate drive control of the resistive heating element 102 based on the detection result of the temperature detection element 105 can be implemented by a relatively simple configuration. This makes it possible to, for example, perform drive control of the resistive heating element 102 at a higher accuracy based on the change of the detection temperature.

Second Embodiment

A temperature detection element 105 is connected to, for example, a constant current source, and a constant current (a current of a predetermined current value) can be supplied to the temperature detection element 105. Hence, a potential difference that can be generated in the temperature detection element 105 is acquired as a detection result, and a control unit (not shown) performs drive control of a resistive heating element 102 based on the detection result. In the above-described first embodiment (see FIG. 1A), the temperature detection element 105 (the metal film that forms the temperature detection element 105) is shown in a rectangular shape. However, the temperature detection element 105 may be formed in another shape to improve the detection accuracy.

Figure 2A:
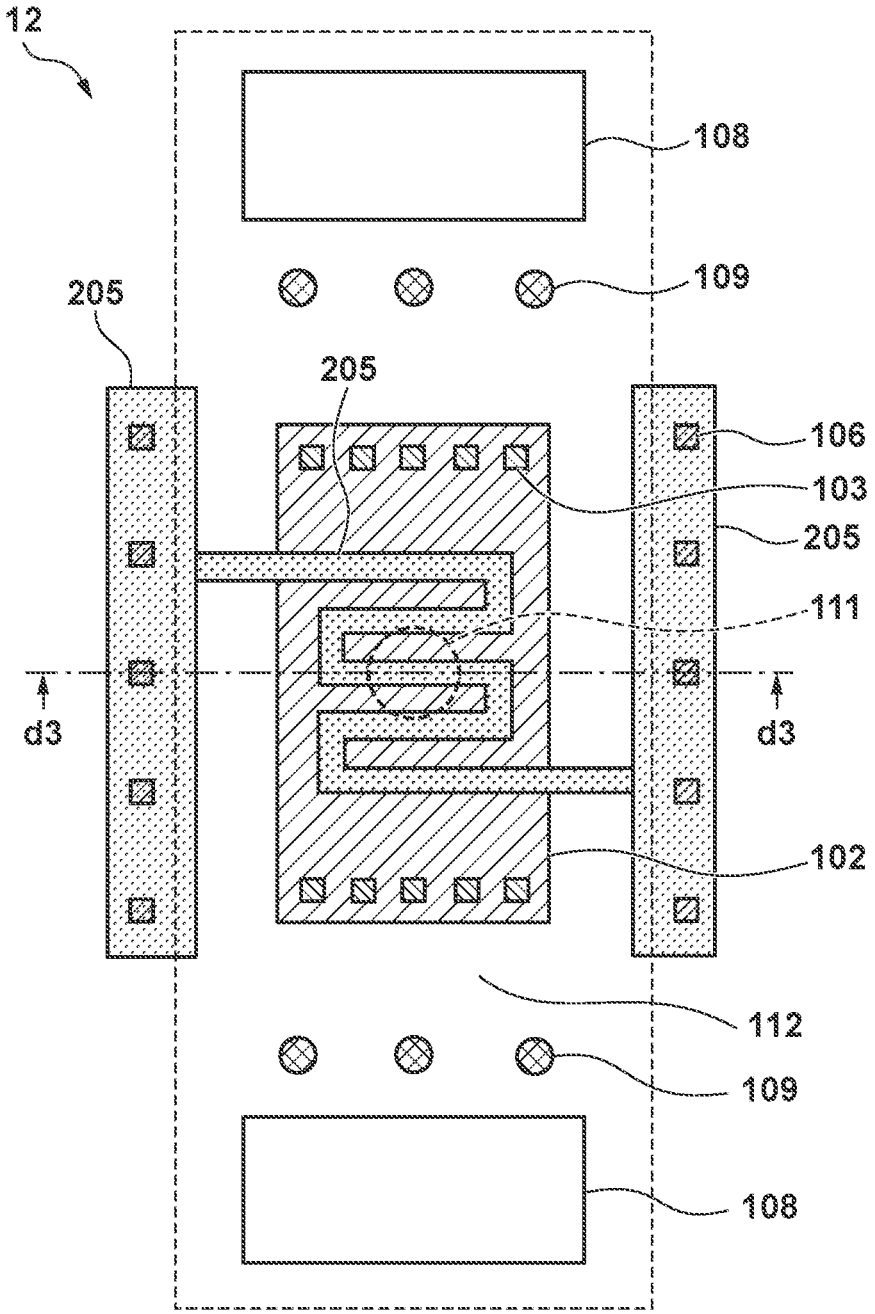
FIG. 2A is a schematic plan view of a liquid discharge head.
Figure 2B:
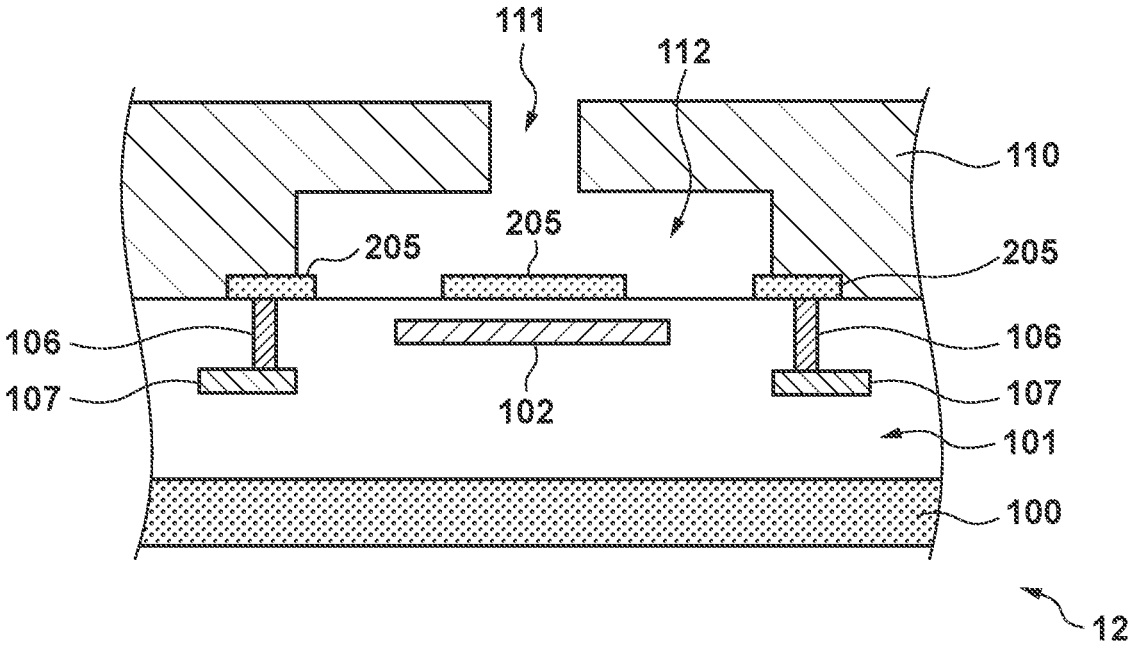
FIG. 2B is a schematic sectional view of the liquid discharge head.

FIG. 2A is a schematic plan view of a head substrate 12 included in a liquid discharge head 1 according to the second embodiment. FIG. 2B is a schematic sectional view taken along a cut line d3-d3 in FIG. 2A. In this embodiment, a temperature detection element (a temperature detection element 205 for the sake of discrimination) is provided in a bent shape above the resistive heating element 102, and this makes the resistance value of the temperature detection element 205 high. Hence, a potential difference that can be generated in the temperature detection element 105 when a constant current is supplied to the temperature detection element 105 becomes large, and the detection accuracy of the temperature detection element 105 is raised.

As another embodiment, the temperature detection element 205 may be narrowed and linearly arranged. The temperature detection element 205 may be arranged along the direction of energization of the resistive heating element 102 so as to pass through the central portion where the temperature readily becomes relatively high in the resistive heating element 102 in a planar view, or may be arranged along a direction orthogonal to the direction of energization.

As described above, according to this embodiment, the same effects as in the first embodiment can be obtained, and the detection accuracy of the temperature detection element 205 can be improved by increasing the resistance value of the temperature detection element 205.

Third Embodiment

In the above-described first embodiment, the temperature detection element 105 is caused to also function as an anti-cavitation film. However, the function for temperature detection and the function as an anti-cavitation film may be individually provided. That is, the temperature detection element 105 (the metal film that forms the temperature detection element 105) and the anti-cavitation film may be provided independently of each other.

Figure 3A:
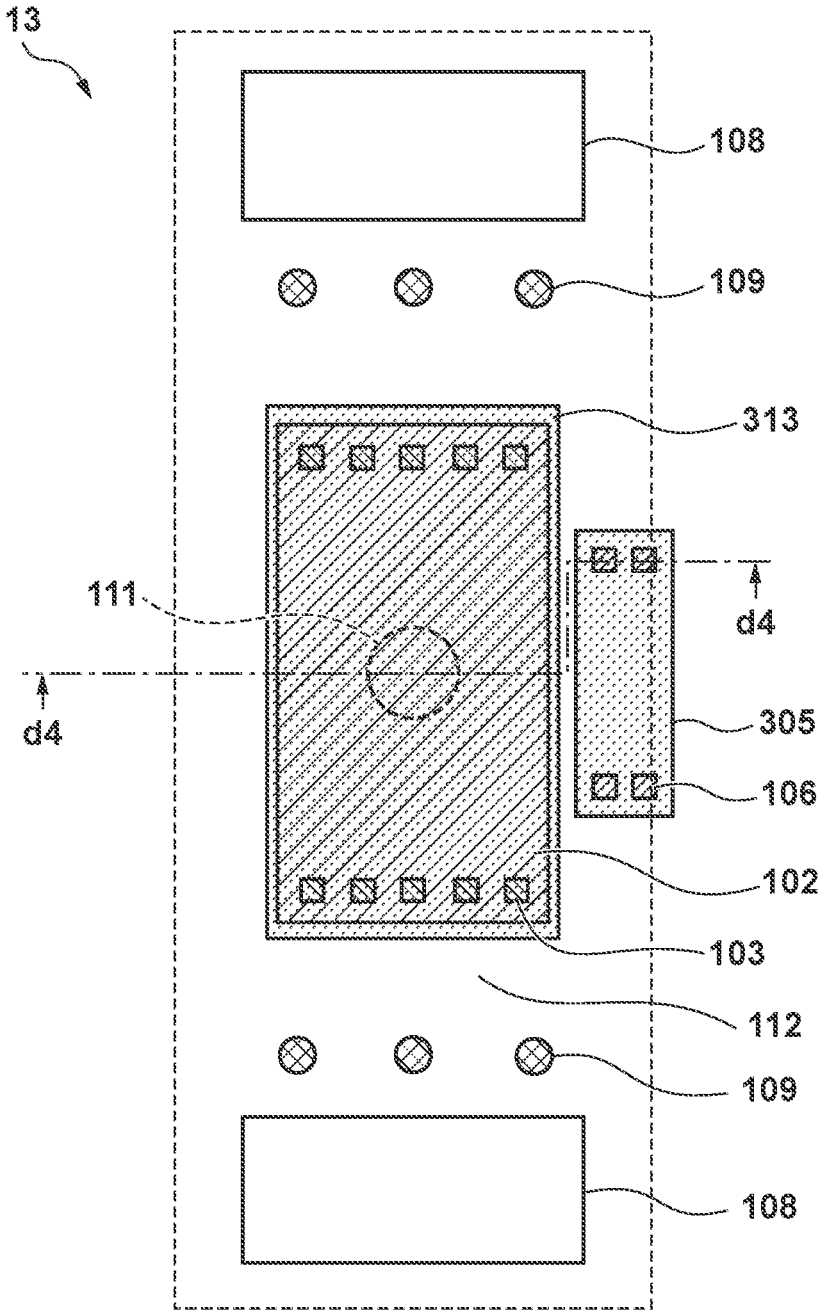
FIG. 3A is a schematic plan view of a liquid discharge head.
Figure 3B:
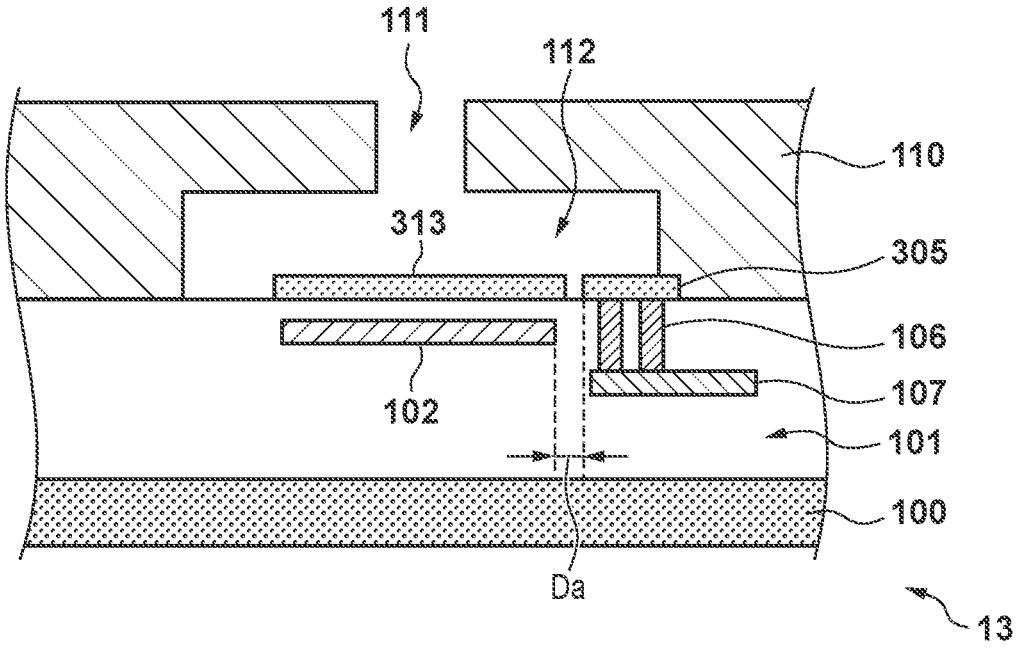
FIG. 3B is a schematic sectional view of the liquid discharge head.

FIG. 3A is a schematic plan view of a head substrate 13 included in a liquid discharge head 1 according to the third embodiment. FIG. 3B is a schematic sectional view taken along a cut line d4-d4 in FIG. 3A. In this embodiment, a temperature detection element (a temperature detection element 305 for the sake of discrimination) and an anti-cavitation film 313 are provided independently of each other.

As described above, bubbles are generated in a liquid by the thermal energy of a resistive heating element 102. The anti-cavitation film protects the resistive heating element 102 from cavitation that can occur due to an impact caused by repetition of generation and disappearance of bubbles and electrochemical corrosion by the liquid. In general, the durability of the anti-cavitation film against cavitation lowers as the temperature becomes high.

Hence, the anti-cavitation film 313 is preferably arranged immediately above a region where the temperature readily rises in the resistive heating element 102. In a planar view, the anti-cavitation film 313 is preferably arranged to at least overlap a region about 5 μm inside from the outer edge of the resistive heating element 102, which corresponds to the effective functional portion of the resistive heating element where the temperature becomes higher.

As is apparent from FIGS. 3A and 3B, in this embodiment, the anti-cavitation film 313 is arranged immediately above the central portion of the resistive heating element 102 and extends up to the outer side of the outer edge of the resistive heating element 102 in a planar view.

The temperature detection element 305 and the anti-cavitation film 313 are electrically isolated from each other. The anti-cavitation film 313 may be floating, or a predetermined voltage may be applied to it. Also, as shown in FIG. 3B, the resistive heating element 102 and the temperature detection element 305 are preferably provided such that a distance (the distance in the horizontal direction of a substrate 100) Da between these becomes small, for example, the distance Da becomes 2 μm or less. To implement this, the temperature detection element 305 and the anti-cavitation film 313 are preferably formed such that the distance between these becomes a minimum value allowable in the semiconductor manufacturing process.

As described above, according to this embodiment, while the temperature detection element 305 and the anti-cavitation film 313 are individually provided, the same effects as in the first embodiment can be obtained. Also, according to this embodiment, since the temperature detection element 305 and the anti-cavitation film 313 are provided close to each other, the durability of the temperature detection element 305 against cavitation can be improved while appropriately maintaining the detection accuracy of the temperature detection element 305.

Note that in this embodiment, the temperature detection element 305 and the anti-cavitation film 313 are formed at once by a known semiconductor manufacturing process and can therefore be arranged in the same layer together and made of the same material.

Fourth Embodiment

In the above-described third embodiment, a form in which the temperature detection element 305 is arranged on one side of the anti-cavitation film 313 has been exemplified. However, the temperature detection element 305 may be arranged on the other side of the anti-cavitation film 313 as well.

Figure 4A:
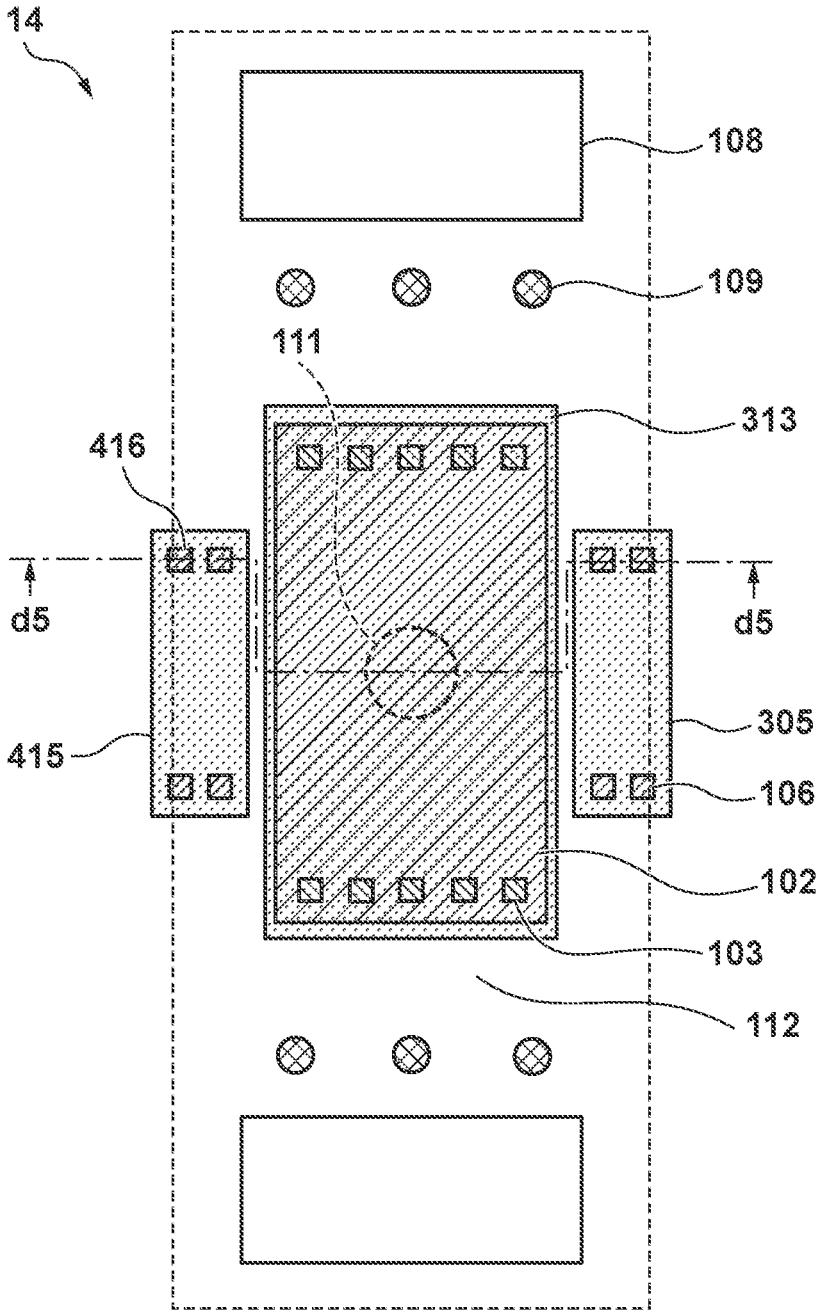
FIG. 4A is a schematic plan view of a liquid discharge head.
Figure 4B:
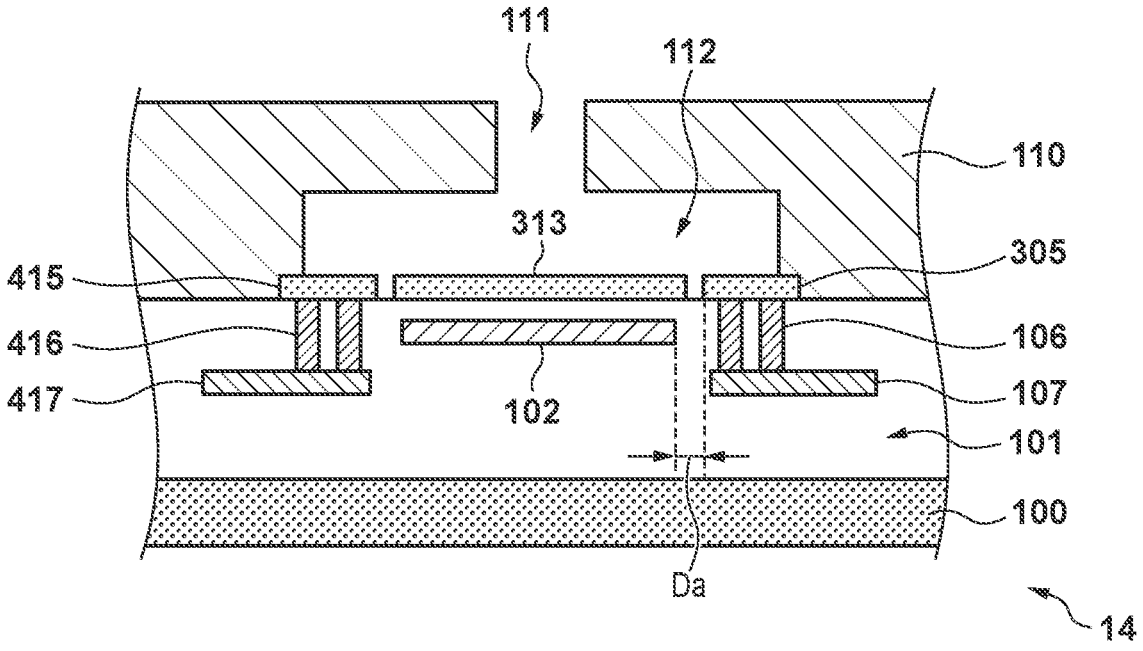
FIG. 4B is a schematic sectional view of the liquid discharge head.

FIG. 4A is a schematic plan view of a head substrate 14 included in a liquid discharge head 1 according to the fourth embodiment. FIG. 4B is a schematic sectional view taken along a cut line d5-d5 in FIG. 4A. In this embodiment, a temperature detection element 305 is arranged on one side of an anti-cavitation film 313, and another temperature detection element (a temperature detection element 415 for the sake of discrimination) is arranged on the other side as well. That is, a pair of temperature detection elements 305 and 415 are arranged on both sides of the anti-cavitation film 313.

According to this embodiment, since the detection results of the two temperature detection elements 305 and 415 can be acquired, the detection accuracy can further be improved as compared to the third embodiment.

The temperature detection element 415 is connected to a wiring member 417 via a connecting member 416. The detection result is acquired independently of the detection result of the temperature detection element 305, and signal processing for the detection results can individually be executed. It is therefore possible to, for example, detect, based on the sensitivity difference between the temperature detection elements 305 and 415, a deviation of the direction of discharge of a liquid (a deviation of a position at which the liquid is adhered to a target).

Note that in this embodiment, a form in which the two temperature detection elements 305 and 415 are arranged for a single resistive heating element 102 has been exemplified. However, the number of temperature detection elements may be three or more.

In addition, a configuration in which the detection results of the temperature detection element 305 and the temperature detection element 415 can be independently acquired has been described. However, the temperature detection element 305 and the temperature detection element 415 may be connected in series. In the latter case, since the resistance value of the temperature detection element becomes high, the detection accuracy can be improved.

Fifth Embodiment

In the above-described third and fourth embodiments, the temperature detection element 305 and the anti-cavitation film 313 are provided individually and close to each other, and the durability of the temperature detection element 305 against cavitation is improved while appropriately maintaining the detection accuracy of the temperature detection element 305. To further improve the detection accuracy, a structural change may be made for the temperature detection element 305.

Figure 5A:
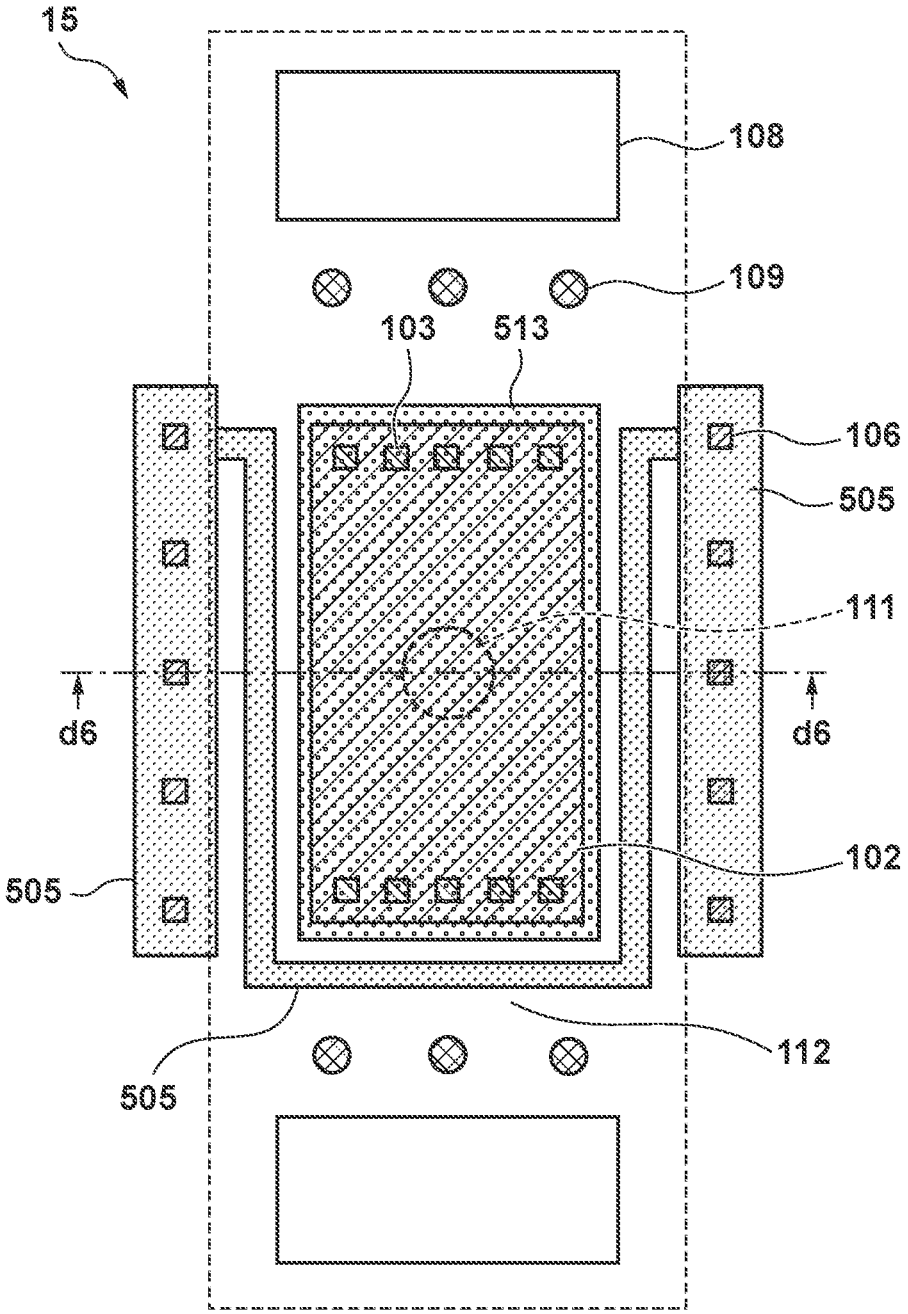
FIG. 5A is a schematic plan view of a liquid discharge head.
Figure 5B:
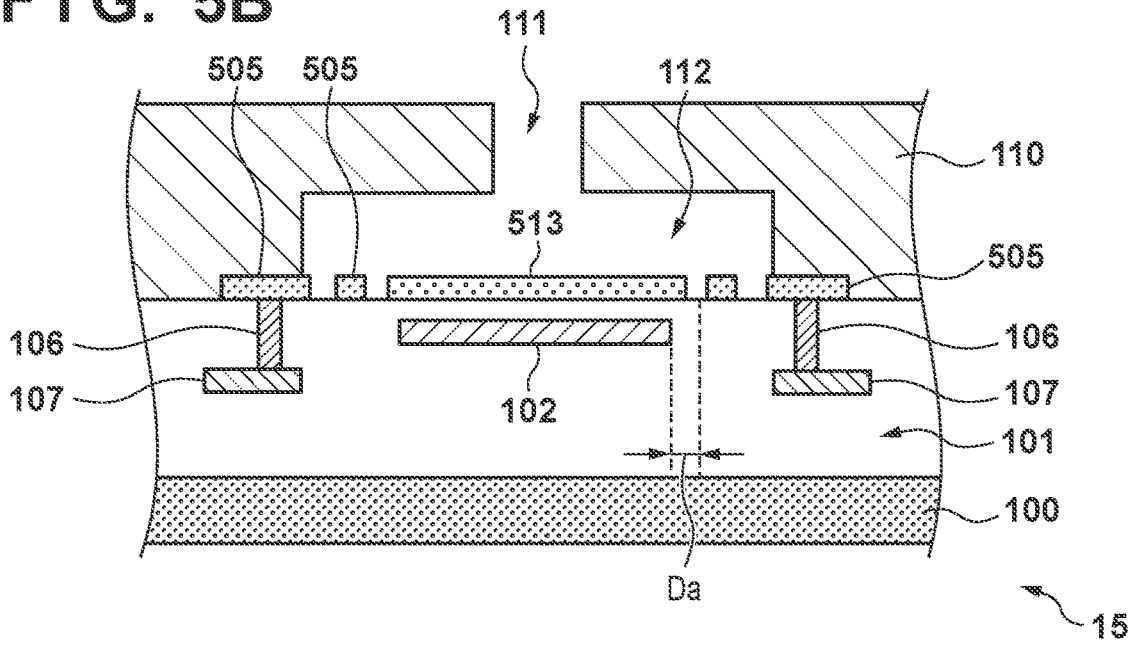
FIG. 5B is a schematic sectional view of the liquid discharge head.

FIG. 5A is a schematic plan view of a head substrate 15 included in a liquid discharge head 1 according to the fifth embodiment. FIG. 5B is a schematic sectional view taken along a cut line d6-d6 in FIG. 5A. In this embodiment, as in the third and fourth embodiments, a temperature detection element (a temperature detection element 505 for the sake of discrimination) and an anti-cavitation film (an anti-cavitation film 513 for the sake of discrimination) are independently provided, and the temperature detection element 505 is configured to include a line pattern.

In this embodiment, the line pattern that forms the temperature detection element 505 is arranged on the outer side of the outer edge of a resistive heating element 102 along the outer periphery of the outer edge in a planar view. According to this embodiment, the resistance value of the temperature detection element 505 is made higher as compared to the third and fourth embodiments, thereby further increasing the detection accuracy of the temperature detection element 505. At this time, as described above (see the third embodiment), the resistive heating element 102 and the temperature detection element 505 are preferably provided such that a distance Da between these becomes small.

Additionally, the anti-cavitation film 513 and the temperature detection element 505 may be locally (preferably at one point) electrically connected to each other. In this case, the heat of the anti-cavitation film 513 can be made to propagate to the temperature detection element 505 without substantially affecting a current flowing to the temperature detection element 505, and the detection accuracy of the temperature detection element 505 can further be increased.

In addition, the anti-cavitation film 513 and the temperature detection element 505 may be made of materials different from each other. This makes it possible to individually implement raising the durability of the anti-cavitation film 513 against cavitation and improving the detection accuracy of the temperature detection element 505. For example, it is preferable to use iridium, tantalum, or the like for the anti-cavitation film 513 and silicon tantalum nitride, silicon tungsten nitride, or the like for the temperature detection element 505.

As shown in FIG. 5B, the temperature detection element 505 and the anti-cavitation film 513 are formed in the same layer. Also, at least the temperature detection element 505 is located close to a liquid in a bubble chamber 112. It is therefore possible to acquire a detection result at a high sensitivity. Hence, the temperature detection element 505 is preferably arranged in the uppermost layer of a plurality of conductive layers provided with respect to an insulating layer 101.

Note that using materials different from each other for the anti-cavitation film 513 and the temperature detection element 505 can be applied to the third and fourth embodiments as well.

As described above, according to this embodiment, the same effects as in the first embodiment can be obtained, and the durability of the temperature detection element 505 and the anti-cavitation film 513 against cavitation can further be improved while further improving the detection accuracy of the temperature detection element 505.

OTHER EMBODIMENTS

The liquid discharge head 1 shown in the embodiments is provided in a liquid discharge device represented by an inkjet printer or the like. The inkjet printer may be a single function printer having only a print function, or may be a multi-function printer having a plurality of functions such as a print function, a FAX function, and a scanner function. Alternatively, the inkjet printer may be a manufacturing apparatus for manufacturing, for example, a color filter, an electronic device, an optical device, a microstructure, or the like by a predetermined printing method.

Additionally, "print" should be interpreted in a broader sense. Hence, "print" can take any form regardless of whether an object to be formed on a print medium is significant information such as a character or graphic pattern and whether it has become obvious to be visually perceivable by humans.

The target of liquid application by the liquid discharge head 1 can also be called a print medium, and "print medium" should be interpreted in a broader sense, like "print". Hence, the concept of "print medium" can include not only paper sheets used in general but also any members capable of receiving ink, including fabrics, plastic films, metal plates, and glass, ceramic, resin, wood, and leather materials.

A typical example of a liquid is ink. Note that the concept of "liquid" can include not only a liquid that forms an image, design, pattern, or the like when applied onto a print medium but also an additional liquid that can be provided to process the print medium or process ink (for example, coagulate or insolubilize color materials in ink).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-094907, filed on May 29, 2020, which is hereby incorporated by reference herein in its entirety.

What is claimed is:

1. A liquid discharge head comprising:

an insulating member arranged on a substrate;

a resistive heating element arranged in the insulating member and configured to generate thermal energy used to discharge a liquid;

a bubble chamber provided above the insulating member and configured to generate bubbles of the liquid based on the thermal energy; and a temperature detection element capable of detecting a temperature in the bubble chamber, wherein the temperature detection element is arranged between the resistive heating element and the bubble chamber and in a conductive layer closest to the bubble chamber in a plurality of conductive layers provided with respect to the insulating member.

2. The head according to claim 1, wherein the temperature detection element overlaps the bubble chamber in a planar view.

3. The head according to claim 1, wherein the temperature detection element detects a change of the temperature in the bubble chamber after driving of the resistive heating element.

4. The head according to claim 1, wherein a discharge form of liquid discharged based on the thermal energy is detected based on a detection result of the temperature detection element.

5. The head according to claim 1, further comprising an anti-cavitation film provided in the bubble chamber and configured to cover the resistive heating element, wherein the temperature detection element and the anti-cavitation film are made of the same material.

6. The head according to claim 5, wherein the temperature detection element and the anti-cavitation film are electrically isolated.

7. The head according to claim 1, wherein the temperature detection element is located on an outer side of the resistive heating element with respect to an outer edge of the resistive heating element in a planar view.

8. The head according to claim 7, wherein the temperature detection element is arranged such that a distance to the resistive heating element in a horizontal direction of the substrate becomes not more than 2 μm.

9. The head according to claim 1, wherein a plurality of temperature detection elements are arranged in correspondence with the resistive heating element.

10. The head according to claim 1, wherein the temperature detection element is arranged to overlap the resistive heating element in a planar view.

11. The head according to claim 10, wherein the temperature detection element is provided in the bubble chamber and also serves as an anti-cavitation film configured to cover the resistive heating element.

12. A liquid discharge device comprising a liquid discharge head defined in claim 1.

13. A liquid discharge head comprising:

an insulating member arranged on a substrate;

a resistive heating element arranged in the insulating member and configured to generate thermal energy used to discharge a liquid;

a bubble chamber provided above the insulating member and configured to generate bubbles of the liquid based on the thermal energy; and a temperature detection element capable of detecting a temperature in the bubble chamber, wherein the temperature detection element is provided in the bubble chamber and arranged to overlap the resistive heating element in a planar view.

14. The head according to claim 13, wherein the temperature detection element detects a change of the temperature in the bubble chamber after driving of the resistive heating element.

15. The head according to claim 13, wherein a discharge form of liquid discharged based on the thermal energy is detected based on a detection result of the temperature detection element.

* * * * *